US006568611B1

(12) United States Patent
Essenmacher

(10) Patent No.: US 6,568,611 B1
(45) Date of Patent: May 27, 2003

(54) AIR BLOWER INFLATION ADAPTER

(76) Inventor: Steven Glenn Essenmacher, 24239 Darwin, Macomb, MI (US) 48042

( * ) Notice: Subject to any disclaimer, the term of this patent is extended or adjusted under 35 U.S.C. 154(b) by 0 days.

(21) Appl. No.: 10/137,277

(22) Filed: May 2, 2002

(51) Int. Cl.[7] ..... F23D 14/48
(52) U.S. Cl. ..... 239/589; 239/289; 239/DIG. 22
(58) Field of Search ..... 239/289, 589, 239/DIG. 22; 285/252, 420

(56) References Cited

U.S. PATENT DOCUMENTS 6,119,738 A * 9/2000 Idol ..... 141/114

* cited by examiner

*Primary Examiner*—Brian L. Casler
*Assistant Examiner*—Lina R Kontos

(57) ABSTRACT

An air blower inflation adapter is provided for quickly inflating an inflatable object with an air blower, comprising a nozzle assembly with a first cylindrical section having an opening fittable to an air blower and a second smaller cylindrical section having an opening fittable to an air release port, and a conic transition section therebetween. The air blower inflation adapter has particular utility in connection with inflating air mattresses, rafts, inflatable pools, and similar objects with a conventional leaf blower that quickly and conveniently provides high volumes of air for the inflation of large objects.

11 Claims, 4 Drawing Sheets

AIR BLOWER INFLATION ADAPTER

BACKGROUND OF THE INVENTION

1. Field of the Invention

The present invention relates to an air blower inflation adapter for use in connection with inflating air mattresses, rafts, inflatable pools, and similar objects. The air blower inflation adapter has particular utility in connection with inflating air mattresses, rafts, inflatable pools, and similar objects with a conventional leaf blower.

2. Description of the Prior Art

An air blower inflation adapter is desirable for inflating air mattresses, rafts, inflatable pools, and similar objects with an air blower such as a conventional leaf blower. Conventional hand inflation pumps and compressors are designed for providing small volumes of air at high pressures for tires, basketballs, footballs, and the like, but are unsuitable for providing high volumes of air for the inflation of large objects at lower air pressures. Use of a conventional hand inflation pump or compressor is therefore very time-consuming for the inflation of such objects as air mattresses, rafts, and inflatable pools.

The use of air blowers is known in the prior art. For example, U.S. Pat. No. 6,076,231 to Bucher discloses a nozzle for a lawn and garden blower. However, the Bucher '231 patent does not provide a profile fittable with inflation valves for pools, floats, rafts, beach balls, and other inflatable objects.

U.S. Pat. No. 4,237,576 to Stakes discloses a blower device for sweeping. However, the Stakes '576 patent does not provide a nozzle assembly with an adapter fittable to the blower and a profile fittable with a wide variety of inflation valves.

Similarly, U.S. Pat. No. Des. 266,355 to Mariol discloses an air blower. However, the Mariol '355 patent does not provide a nozzle assembly with an adapter fittable to the blower and a profile fittable with a wide variety of inflation valves.

U.S. Pat. No. 5,722,111 to Sowell, et al. discloses a blower vacuum. However, the Sowell '111 patent does not provide a nozzle assembly with an adapter fittable to the blower and a profile fittable with a wide variety of inflation valves.

U.S. Pat. No. 5,605,356 to Salvi discloses an air inflater adapter. However, the Salvi '356 patent does not provide a nozzle assembly with an adapter fittable to a conventional leaf blower and a profile fittable with a wide variety of inflation valves.

U.S. Pat. No. 6,008,938 to Suehle, et al. discloses an inflatable portable projection screen. However, the Suehle '938 patent does not provide a nozzle assembly with an adapter fittable to a blower and a profile fittable with a wide variety of inflation valves.

Similarly, U.S. Pat. No. 5,471,797 to Murphy discloses an inflatable enclosure. However, the Murphy '797 patent does not provide a nozzle assembly with an adapter fittable to a blower and a profile fittable with a wide variety of inflation valves.

Lastly, U.S. Pat. No. 5,238,406 to Littell, III discloses thermal contrast detailing for inflatable decoy targets. However, the Littell '406 patent does not provide a nozzle assembly with an adapter fittable to a conventional leaf blower and a profile fittable with a wide variety of inflation valves.

While the above-described devices fulfill their respective, particular objectives and requirements, the aforementioned patents do not describe an air blower inflation adapter that allows the inflation of air mattresses, rafts, inflatable pools, and similar objects. The prior art patents make no provision for inflating air mattresses, rafts, inflatable pools, and similar objects with a conventional leaf blower.

Therefore, a need exists for a new and improved air blower inflation adapter that can be used for inflating air mattresses, rafts, inflatable pools, and similar objects. In this regard, the present invention substantially fulfills this need. In this respect, the air blower inflation adapter according to the present invention substantially departs from the conventional concepts and designs of the prior art, and in doing so provides an apparatus primarily developed for the purpose of inflating air mattresses, rafts, inflatable pools, and similar objects with a conventional leaf blower.

SUMMARY OF THE INVENTION

In view of the foregoing disadvantages inherent in the known types of air blowers now present in the prior art, the present invention provides an improved air blower inflation adapter, and overcomes the above-mentioned disadvantages and drawbacks of the prior art. As such, the general purpose of the present invention, which will be described subsequently in greater detail, is to provide a new and improved air blower inflation adapter which has all the advantages of the prior art mentioned heretofore and many novel features that result in an air blower inflation adapter which is not anticipated, rendered obvious, suggested, or even implied by the prior art, either alone or in any combination thereof.

To attain this, the present invention essentially comprises an air blower inflation adapter, comprising a nozzle assembly with a first cylindrical section having an opening fittable to an air blower and a second smaller cylindrical section having an opening fittable to an air release port, and a conic transition section therebetween.

In one embodiment, the present invention comprises an air blower inflation adapter for quickly inflating an inflatable object with an air blower, comprising a nozzle assembly with a first cylindrical section having an opening fittable to an air blower and a second smaller cylindrical section having an opening fittable to an air release port, and a conic transition section therebetween.

In another embodiment, the present invention comprises an air blower inflation adapter, comprising a nozzle assembly with a first cylindrical section having an opening fittable to an air blower, a second smaller cylindrical section having an opening fittable to an air release port, a conic transition section between the first cylindrical section and the second cylindrical section, a slot in the first cylindrical section, a bar connected to the outside diameter of the first cylindrical section of the nozzle assembly, a strap connected to the outside diameter of the first cylindrical section of the nozzle assembly, and fasteners connected to the strap, wherein looping the strap around the bar and connecting the fasteners reduces the width of the slot and reduces the diameter of the first cylindrical section of the nozzle assembly to facilitate connection to the air blower.

In yet another embodiment, the present invention comprises an air blower inflation adapter for quickly inflating an inflatable object with an air blower, comprising a nozzle assembly with a first cylindrical section having an opening fittable to an air blower, a second smaller cylindrical section having an opening fittable to an air release port, a conic transition section between the first cylindrical section and the second cylindrical section, a slot in the first cylindrical section, a bar connected to the outside diameter of the first cylindrical section of the nozzle assembly, a strap connected to the outside diameter of the first cylindrical section of the nozzle assembly, and fasteners connected to the strap, wherein looping the strap around the bar and connecting the fasteners reduces the width of the slot and reduces the diameter of the first cylindrical section of the nozzle assembly to facilitate connection to the air blower.

There has thus been outlined, rather broadly, the more important features of the invention in order that the detailed description thereof that follows may be better understood and in order that the present contribution to the art may be better appreciated.

The invention may also include an adapter for connecting the nozzle assembly to an air blower and an adapter for connecting the nozzle assembly to an air release port. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air blower inflation adapter that has all of the advantages of the prior art air blowers and none of the disadvantages.

It is another object of the present invention to provide a new and improved air blower inflation adapter that may be easily and efficiently manufactured and marketed.

An even further object of the present invention is to provide a new and improved air blower inflation adapter that has a low cost of manufacture with regard to both materials and labor, and which accordingly is then susceptible of low prices of sale to the consuming public, thereby making such air blower inflation adapter economically available to the buying public.

Still another object of the present invention is to provide a new air blower inflation adapter that provides in the apparatuses and methods of the prior art some of the advantages thereof, while simultaneously overcoming some of the disadvantages normally associated therewith.

Even still another object of the present invention is to provide an air blower inflation adapter for inflating air mattresses, rafts, inflatable pools, and similar objects. This allows a user to inflate such items more quickly and conviently than with a conventional air pump.

Still yet another object of the present invention is to provide an air blower inflation adapter for inflating air mattresses, rafts, inflatable pools, and similar objects with a conventional leaf blower. This makes it possible to use the high volume of air provided by the leaf blower to inflate these items very quickly and conveniently.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
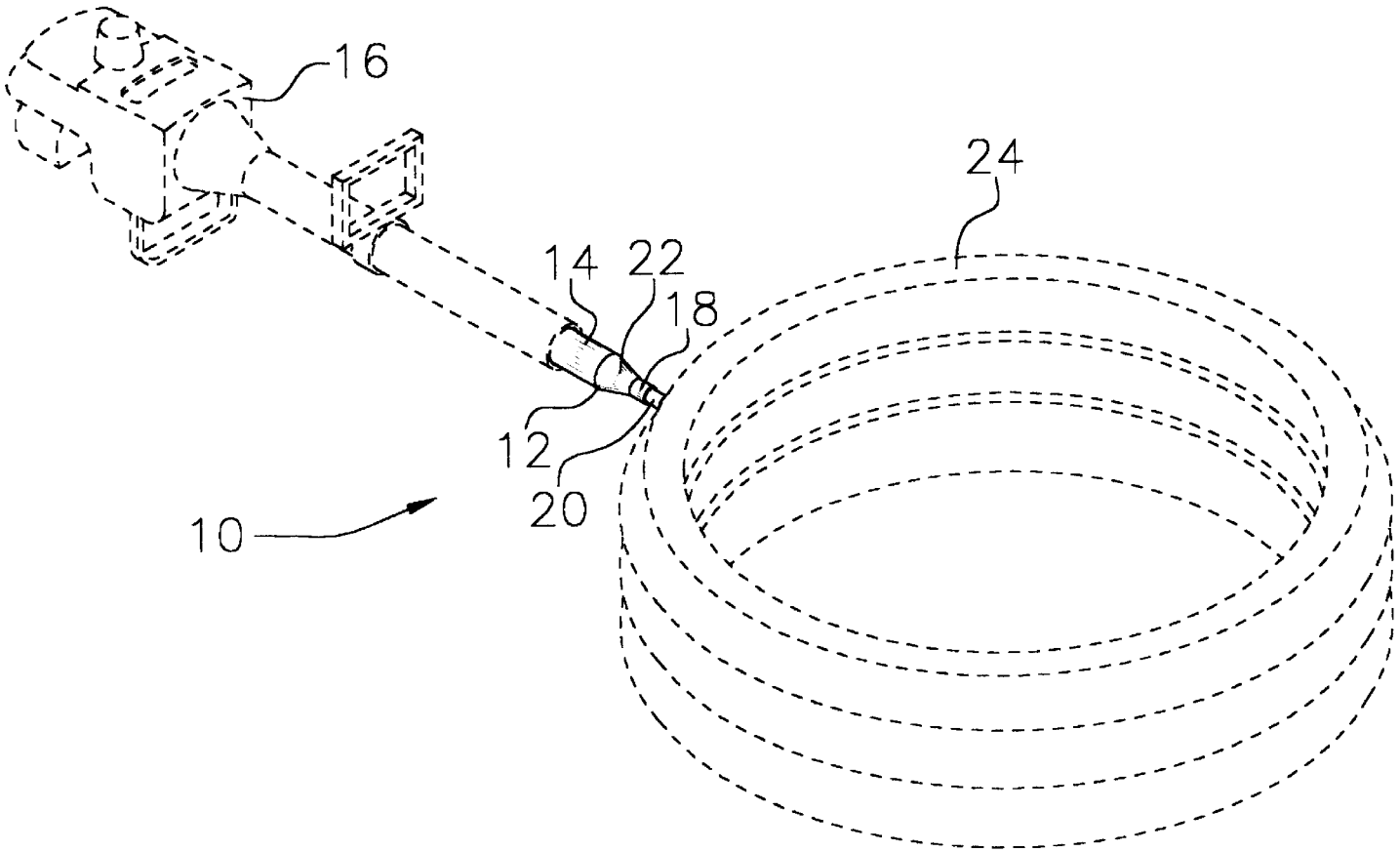
FIG. 1 is a left perspective view from above the preferred embodiment of the air blower inflation adapter constructed in accordance with the principles of the present invention.

Referring now to the drawings, and particularly to FIGS. 1–6, a preferred embodiment of the air blower inflation adapter of the present invention is shown and generally designated by the reference numeral 10.

In FIG. 1, a new and improved air blower inflation adapter 10 of the present invention for inflating air mattresses, rafts, inflatable pools, and similar objects with a conventional leaf blower is illustrated and will be described. More particularly, the air blower inflation adapter 10 comprises a nozzle assembly 12 with a first cylindrical section 14 having an opening fittable to an air blower 16 and a second smaller cylindrical section 18 having an opening fittable to an air release port 20, and a conic transition section 22 between the two cylindrical sections. An inflatable pool 24 is also shown, although the air blower inflation adapter 10 of the present invention is suitable for inflating any low pressure inflatable item such as a float, a raft, an air mattress, and the like.

Figure 2:
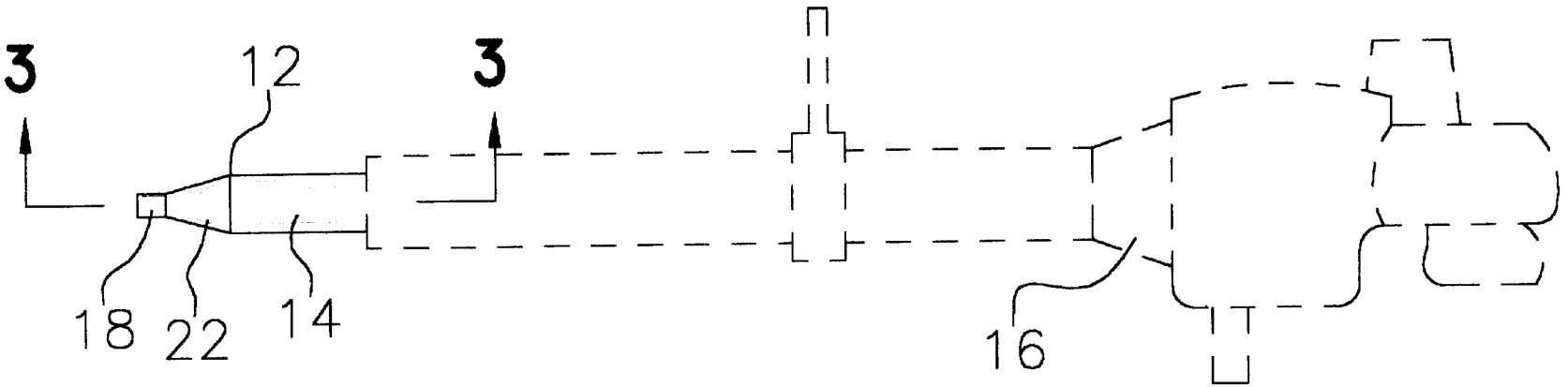
FIG. 2 is a right elevational view of the air blower inflation adapter of the present invention.

FIG. 2 is a right elevational view of the air blower inflation adapter of the present invention, and illustrates the nozzle assembly 12, first cylindrical section 14, air blower 16, second smaller cylindrical section 18, and conic transition section 22.

Figure 3:
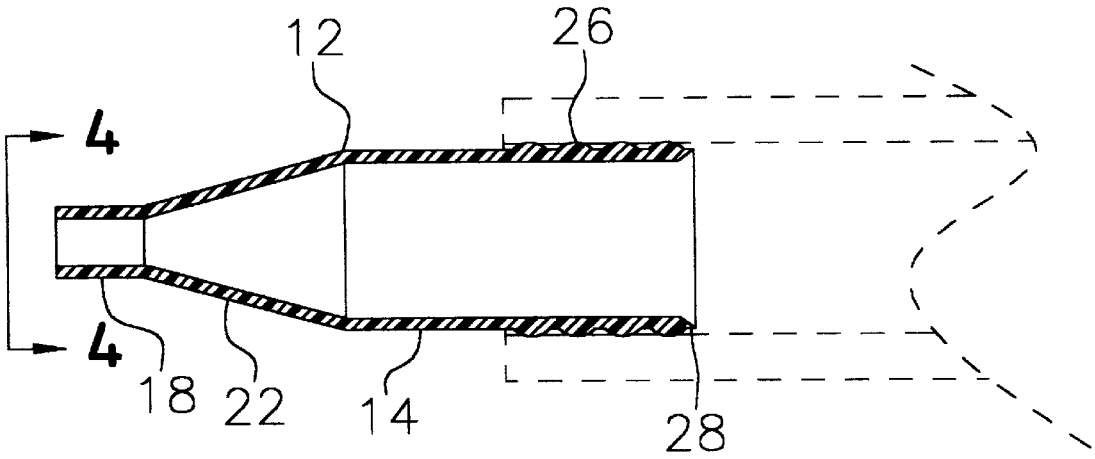
FIG. 3 is a top cross-sectional view of the air blower inflation adapter of the present invention shown in FIG. 2 taken along the line 3—3.

FIG. 3 is a top cross-sectional view of the air blower inflation adapter of the present invention, and illustrates the nozzle assembly 12, first cylindrical section 14, second smaller cylindrical section 18, and conic transition section 22. The outer surface of the first cylindrical section 14 having an opening fittable to an air blower has a ribbed surface 26 to facilitate connection to the internal surface of an air blower or air blower nozzle. The end of the first cylindrical section 14 having an opening fittable to the air blower also has a taper 28 to facilitate insertion into and connection to an internal surface of an air blower or air blower nozzle.

Figure 4:
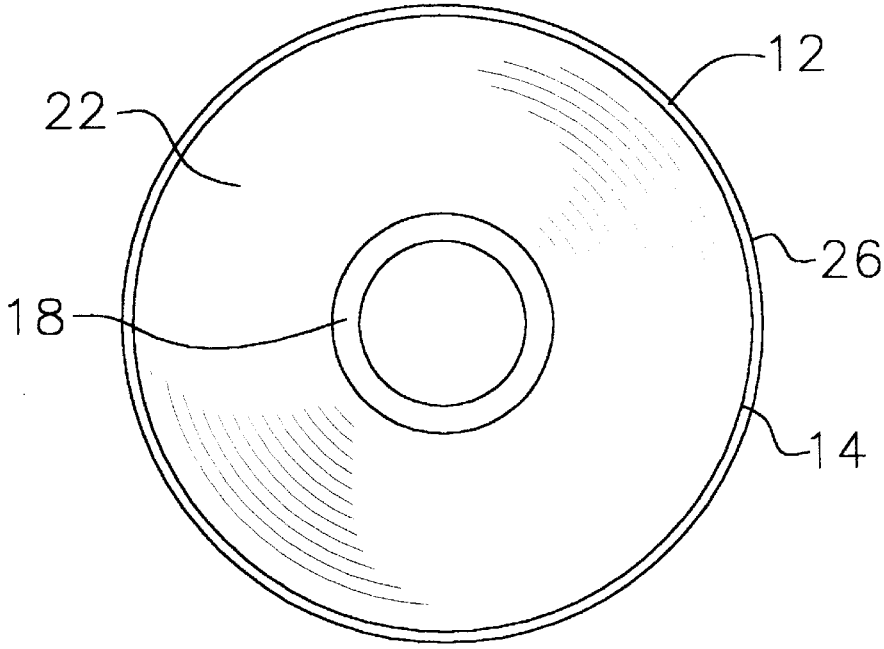
FIG. 4 is a front elevational view of the air blower inflation adapter of the present invention shown in FIG. 3 taken along the line 4—4.

FIG. 4 is a front elevational view of the air blower inflation adapter of the present invention, and illustrates the nozzle assembly 12, first cylindrical section 14, second smaller cylindrical section 18, conic transition section 22, and ribbed surface 26.

Figure 5:
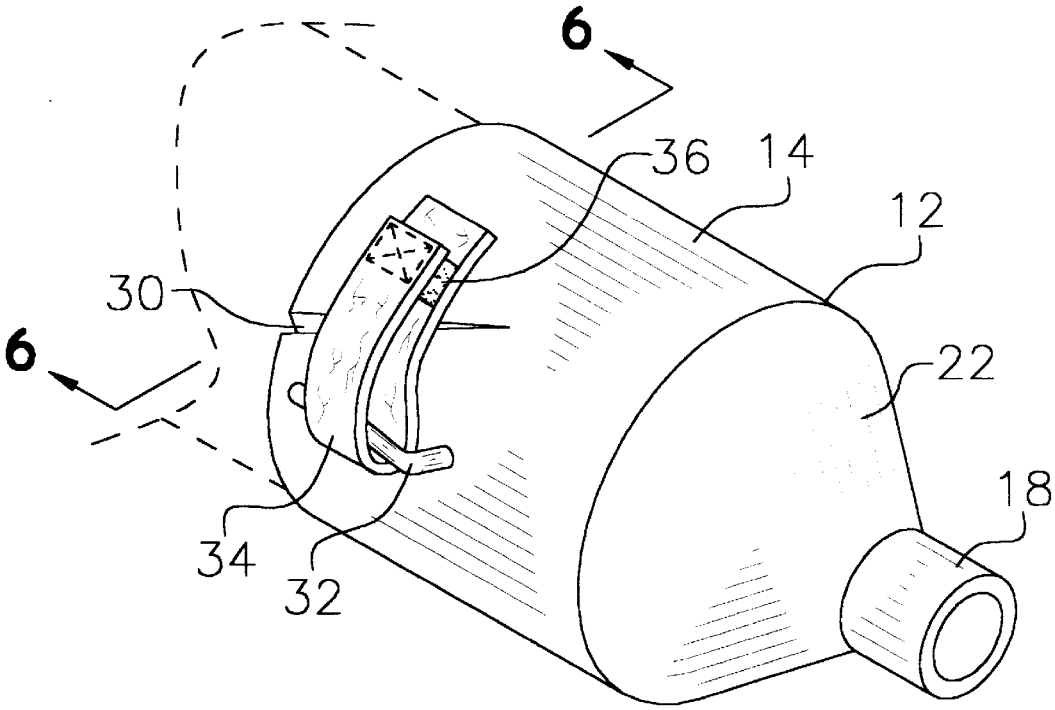
FIG. 5 is a left perspective view from above another embodiment of the air blower inflation adapter of the present invention.

FIG. 5 is a left perspective view from above another embodiment of the air blower inflation adapter of the present invention, and illustrates the nozzle assembly 12, first cylindrical section 14, second smaller cylindrical section 18, and conic transition section 22. The first cylindrical section 14 having an opening fittable to an air blower has a slot 30, a bar 32 connected to the outside diameter of the first cylindrical section 14 of the nozzle assembly 12, a strap 34 connected to the outside diameter of the first cylindrical section 14 of the nozzle assembly 12, and fasteners 36 connected to the strap 34, wherein looping the strap 34 around the bar 32 and connecting the fasteners 36 reduces the width of the slot 30 and reduces the diameter of the first cylindrical section 14 of the nozzle assembly 12 to facilitate connection around an air blower fitting or nozzle. The strap 34 and fasteners 36 are adjustable for use with different sizes of air blower fittings and nozzles. The fasteners 36 may be hook and loop fasteners, belt-buckle type fasteners, or any other known fasteners or connectors.

Figure 6:
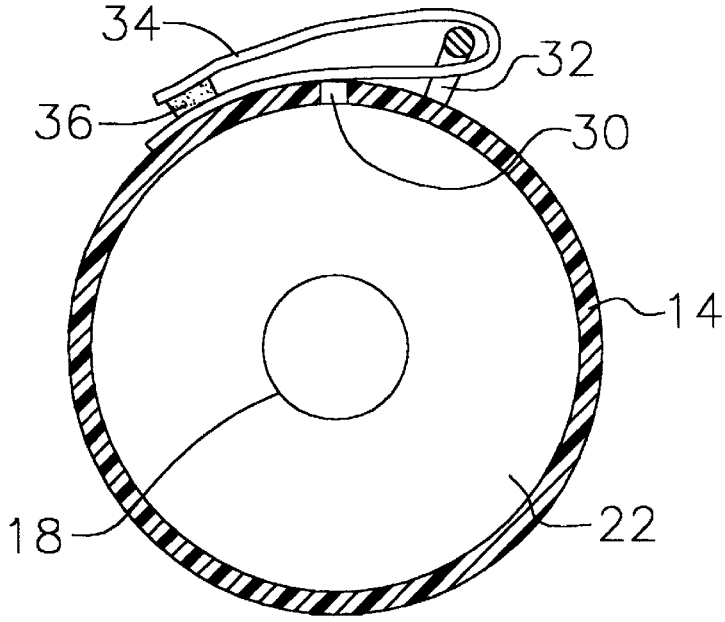
FIG. 6 is a front elevational cross-sectional view of the embodiment of the air blower inflation adapter of the present invention shown in FIG. 5 taken along the line 6—6.

FIG. 6 is a front elevational cross-sectional view of the embodiment of the air blower inflation adapter of the present invention, and illustrates the first cylindrical section 14, second smaller cylindrical section 18, and conic transition section 22. The first cylindrical section 14 has a slot 30, a bar 32, a strap 34, and fasteners 36 connected to the strap 34, wherein the strap 34 is looped around the bar 32, connecting the fasteners 36.

The air blower inflation adapter of the present invention preferably comprises rigid plastic. Suitable plastics include molded poly(vinyl chloride) (PVC), polystyrene (PS), polypropylene (PP), a polyethylene (PE) such as high density polyethylene (HDPE), an acrylonitrile-butadiene-styrene (ABS) resin, a styrene-acrylonitrile (SAN) resin, polycarbonate (PC), a polyester such as polyethylene terephthalate (PET) or polybutylene terephthalate (PBT), and any other rigid plastic. The nozzle assembly may be any color and may comprise a single molded piece or it may comprise different pieces with any suitable air-tight connection. Sizes of the cylindrical sections may be varied for different sizes of air blower adapters and nozzles and different air release ports.

A wide variety of attachments to an air blower such as clamps, threads, tapes, adhesives, and wedges may be used instead of the ribbed surface, taper, or fastened strap over the slotted cylinder described. Adapters and connectors may also be used to attach the air blower inflation adapter of the present invention to air blowers and to a wide variety of air release ports, including those comprising inflation valves. In a preferred embodiment, the profile of the second smaller cylindrical section is fittable with a wide variety of inflation valves.

In one embodiment, the air blower inflation adapter of the present invention is an adapter fitting that permits leaf blowers with 2½-inch outlet tubes to be used to inflate large air mattresses, inflatable swimming pools, and related products. In one embodiment, it comprises a plastic sleeve that is about 8 inches long, with about a 4-inch long section at one end that features a constant internal diameter of about 2.59 inches. The other end features about a ¾-inch long section that incorporates an internal diameter of about 1.080 inches. Between the two ends is a conical transition section. The air blower inflation adapter of the present invention enables inflatable pools, large air mattresses, and related items to be inflated via a leaf blower.

The appealing features of the air blower inflation adapter of the present invention include its ease of use, versatility, convenience, small size, and simplicity. The small size and simplicity of this adapter endow it with a comparatively modest price, much less than that of even a simple manual inflation pump. Its design enables it to be used to inflate most typical large inflatable pools, larger air mattresses, and related products via their air release ports. Its ability to permit a leaf blower to be used for this purpose enables such items to be inflated with a fraction of the time and effort normally required.

In use, it can now be understood that the air blower inflation adapter of the present invention has particular utility in connection with inflating air mattresses, rafts, inflatable pools,and similar objects with a conventional leaf blower.

While a preferred embodiment of the air blower inflation adapter has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or composite material may be used instead of the rigid plastic described. Also, the strap may be made of fabric, rubber, plastic, or similar material. And although inflating air mattresses, rafts, inflatable pools, and similar objects with a conventional leaf blower has been described, it should be appreciated that the air blower inflation adapter herein described is also suitable for increasing the velocity of air from an air blower for cleaning purposes. Furthermore, a wide variety of attachments to an air blower such as clamps, threads, and wedges may be used instead of the ribbed surface or fastened strap over the slotted cylinder described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air blower inflation adapter, comprising a rigid plastic nozzle assembly with a first cylindrical section having an opening fittable to an air blower and a second smaller cylindrical section having an opening fittable to an air release port, and a conic transition section therebetween.

2. An air blower inflation adapter, comprising a nozzle assembly with a first cylindrical section having an opening fittable to an air blower and a second smaller cylindrical section having an opening fittable to an air release port, and a conic transition section therebetween, wherein the outer surface of the first cylindrical section has an opening fittable to the air blower is ribbed to facilitate connection to the air blower.

3. An air blower inflation adapter, comprising:

a nozzle assembly with a first cylindrical section having an opening fittable to an air blower, a second smaller cylindrical section having an opening fittable to an air release port, a conic transition section between the first cylindrical section and the second cylindrical section, and a slot in the first cylindrical section;

a bar connected to the outside diameter of the first cylindrical section of the nozzle assembly;

a strap connected to the outside diameter of the first cylindrical section of the nozzle assembly; and fasteners connected to the strap;

wherein looping the strap around the bar and connecting the fasteners reduces the width of the slot and reduces the diameter of the first cylindrical section of the nozzle assembly to facilitate connection to the air blower.

4. The air blower inflation adapter of claim 3, further comprising an adapter connecting the nozzle assembly to the air release port.

5. The air blower inflation adapter of claim 3, wherein the inner surface of the first cylindrical section having an opening fittable to the air blower is ribbed to facilitate connection to the air blower.

6. The air blower inflation adapter of claim 3, wherein the profile of the second smaller cylindrical section is fittable with a wide variety of air release ports.

7. The air blower inflation adapter of claim 3, wherein the air blower is a conventional leaf blower.

8. The air blower inflation adapter of claim 3, comprising rigid plastic.

9. An air blower inflation adapter for quickly inflating an inflatable object with an air blower, comprising:

a nozzle assembly with a first cylindrical section having an opening fittable to an air blower, a second smaller cylindrical section having an opening fittable to an air release port, and a conic transition section therebetween;

a slot in the first cylindrical section of the nozzle assembly;

a bar connected to the outside diameter of the first cylindrical section of the nozzle assembly;

a strap connected to the outside diameter of the first cylindrical section of the nozzle assembly; and fasteners connected to the strap;

wherein looping the strap around the bar and connecting the fasteners reduces the width of the slot and reduces the diameter of the first cylindrical section of the nozzle assembly to facilitate connection to the air blower.

10. The air blower inflation adapter of claim 9, wherein the fasteners comprise hook and loop fasteners.

11. The air blower inflation adapter of claim 10, comprising rigid plastic.

* * * * *